US008745883B2

(12) United States Patent
Murgida et al.

(10) Patent No.: US 8,745,883 B2
(45) Date of Patent: Jun. 10, 2014

(54) RAZOR HANDLE WITH A ROTATABLE PORTION

(75) Inventors: Matthew Frank Murgida, Somerville, MA (US); Robert Harold Johnson, Melrose, MA (US); Paul Fathallah, Marion, MA (US)

(73) Assignee: The Gillette Company, Boston, MA (US)

( * ) Notice: Subject to any disclaimer, the term of this patent is extended or adjusted under 35 U.S.C. 154(b) by 371 days.

(21) Appl. No.: 13/221,025

(22) Filed: Aug. 30, 2011

(65) Prior Publication Data

US 2012/0073150 A1 Mar. 29, 2012

Related U.S. Application Data

(60) Provisional application No. 61/387,627, filed on Sep. 29, 2010.

(51) Int. Cl.
*B26B 21/52* (2006.01)

(52) U.S. Cl.
USPC ..... 30/527; 30/532

(58) Field of Classification Search
USPC ..... 30/47–50, 526–533
See application file for complete search history.

(56) References Cited

U.S. PATENT DOCUMENTS

| | | | | |
|---|---|---|---|---|
| 831,259 A | | 9/1906 | Bingler | |
| 1,015,575 A | | 1/1912 | Meyer | |
| 1,552,234 A | | 9/1925 | Roebuck | |
| 1,639,441 A | | 8/1927 | Spahr | |
| 1,693,532 A | | 11/1928 | Stewart | |
| 2,083,172 A | | 6/1937 | Smith | |
| 2,194,815 A | | 3/1940 | Testi | |
| 2,844,870 A | | 7/1958 | Roces et al. | |
| 3,935,639 A | | 2/1976 | Terry et al. | |
| 3,950,848 A | * | 4/1976 | Goldstein | 30/47 |
| 3,950,849 A | * | 4/1976 | Perry | 30/47 |
| 3,964,160 A | | 6/1976 | Gordon | |
| 4,083,103 A | | 4/1978 | Estandian | |
| 4,152,828 A | * | 5/1979 | Lund | 30/529 |
| 4,403,414 A | * | 9/1983 | Kiraly et al. | 30/531 |
| 4,446,619 A | * | 5/1984 | Jacobson | 30/526 |
| 4,475,286 A | * | 10/1984 | Saito | 30/527 |

(Continued)

FOREIGN PATENT DOCUMENTS

| | | |
|---|---|---|
| CA | 1045365 | 1/1979 |
| DE | 202004014032 U1 | 1/2005 |
| EP | 0 885 697 A1 | 12/1998 |
| FR | 2639280 A1 | 5/1990 |

(Continued)

OTHER PUBLICATIONS

PCT International Search Report with Written Opinion in corresponding Int'l appln. PCT/US2011/053617 dated Dec. 20, 2011.

*Primary Examiner* — Jason Daniel Prone
(74) *Attorney, Agent, or Firm* — Kevin C. Johnson; Steven W. Miller

(57) ABSTRACT

A handle for a shaving razor in which the handle has a frame and a pod operably coupled to the frame such that the pod is configured to rotate about an axis substantially perpendicular to the frame. The pod has a base and a cantilever tail extending from the base. A distal end of the cantilever tail is loosely retained by the frame. The cantilever tail generates a return torque upon rotation of the pod about the axis.

7 Claims, 10 Drawing Sheets

(56) References Cited

U.S. PATENT DOCUMENTS

| | | | | |
|---|---|---|---|---|
| 4,488,357 | A | 12/1984 | Jacobson | |
| 4,785,534 | A | 11/1988 | Lazarchik | |
| 4,797,998 | A | 1/1989 | Motta | |
| 4,837,930 | A | 6/1989 | Righi | |
| 4,879,811 | A * | 11/1989 | Cooney | 30/527 |
| 4,942,662 | A * | 7/1990 | Radcliffe | 30/49 |
| 4,970,784 | A | 11/1990 | Althaus et al. | |
| 5,029,391 | A | 7/1991 | Althaus et al. | |
| 5,033,152 | A | 7/1991 | Althaus | |
| 5,038,472 | A | 8/1991 | Iderosa | |
| 5,050,301 | A * | 9/1991 | Apprille, Jr. | 30/529 |
| 5,084,969 | A | 2/1992 | Althaus | |
| 5,093,991 | A | 3/1992 | Hendrickson | |
| 5,167,069 | A * | 12/1992 | Quinn | 30/527 |
| 5,222,300 | A | 6/1993 | Althaus et al. | |
| 5,224,267 | A | 7/1993 | Simms et al. | |
| 5,313,706 | A | 5/1994 | Motta et al. | |
| 5,416,974 | A | 5/1995 | Wain | |
| 5,526,568 | A | 6/1996 | Copelan | |
| 5,535,518 | A | 7/1996 | Althaus | |
| 5,560,106 | A | 10/1996 | Armbruster et al. | |
| 5,579,580 | A | 12/1996 | Althaus et al. | |
| 5,678,316 | A | 10/1997 | Althaus et al. | |
| 5,771,591 | A | 6/1998 | Armbruster et al. | |
| 5,787,593 | A | 8/1998 | Althaus | |
| 5,813,293 | A | 9/1998 | Apprille, Jr. et al. | |
| 5,822,869 | A | 10/1998 | Metcalf et al. | |
| 5,865,189 | A | 2/1999 | Andrews | |
| 5,953,824 | A | 9/1999 | Ferraro et al. | |
| 5,953,825 | A | 9/1999 | Christman et al. | |
| 6,115,924 | A | 9/2000 | Oldroyd | |
| 6,182,366 | B1 | 2/2001 | Richard | |
| 6,247,234 | B1 | 6/2001 | Hill et al. | |
| 6,301,786 | B1 | 10/2001 | Oswald et al. | |
| 6,311,400 | B1 | 11/2001 | Hawes et al. | |
| 6,357,117 | B1 | 3/2002 | Eichhorn et al. | |
| 6,381,857 | B1 | 5/2002 | Oldroyd | |
| 6,421,925 | B1 * | 7/2002 | Wonderley | 30/532 |
| 6,612,040 | B2 * | 9/2003 | Gilder | 30/530 |
| 6,615,498 | B1 | 9/2003 | King et al. | |
| 6,675,480 | B2 | 1/2004 | Oswald | |
| 6,688,002 | B2 | 2/2004 | Momose et al. | |
| 6,880,253 | B1 | 4/2005 | Gyllerstrom | |
| 6,935,029 | B2 | 8/2005 | Morisugi et al. | |
| 7,017,270 | B2 | 3/2006 | Shiba et al. | |
| 7,020,966 | B2 | 4/2006 | Shiba et al. | |
| 7,127,818 | B2 | 10/2006 | Sato et al. | |
| 7,137,205 | B2 | 11/2006 | Royle | |
| 7,140,116 | B2 | 11/2006 | Coffin | |
| 7,162,801 | B2 | 1/2007 | Royle | |
| 7,168,173 | B2 | 1/2007 | Worrick, III | |
| 7,185,436 | B2 | 3/2007 | Murphy et al. | |
| 7,200,938 | B2 | 4/2007 | Lembke | |
| 7,363,715 | B2 * | 4/2008 | Coffin et al. | 30/531 |
| 7,461,456 | B2 | 12/2008 | Tsushio et al. | |
| 7,503,117 | B2 | 3/2009 | Wetzel et al. | |
| 7,685,720 | B2 | 3/2010 | Efthimiadis et al. | |
| 7,690,122 | B2 | 4/2010 | Worrick, III et al. | |
| 7,877,879 | B2 | 2/2011 | Nakasuka | |
| 7,895,754 | B2 | 3/2011 | Blackburn | |
| 7,913,393 | B2 | 3/2011 | Royle et al. | |
| 7,937,837 | B2 | 5/2011 | Psimadas et al. | |
| 7,971,363 | B2 | 7/2011 | Nakasuka | |
| 8,024,863 | B2 | 9/2011 | Wain | |
| 8,033,022 | B2 | 10/2011 | Ben-Ari | |
| 8,033,023 | B2 | 10/2011 | Johnson et al. | |
| 8,061,041 | B2 | 11/2011 | Jessemey et al. | |
| 8,065,802 | B2 | 11/2011 | Oglesby et al. | |
| 8,079,147 | B2 | 12/2011 | Wonderley | |
| 8,151,466 | B2 | 4/2012 | Putzer | |
| 8,151,472 | B2 | 4/2012 | Dimitris et al. | |
| 8,166,658 | B2 | 5/2012 | Nakasuka | |
| 8,166,661 | B2 | 5/2012 | King | |
| 8,205,343 | B2 | 6/2012 | Winter et al. | |
| 8,205,344 | B2 | 6/2012 | Stevens | |
| 8,234,789 | B2 | 8/2012 | Avens et al. | |
| 8,261,451 | B2 | 9/2012 | Macove | |
| 8,286,354 | B2 | 10/2012 | Walker, Jr. et al. | |
| 2002/0104223 | A1 | 8/2002 | Oldroyd | |
| 2002/0116832 | A1 * | 8/2002 | Coffin | 30/527 |
| 2005/0000100 | A1 | 1/2005 | Coffin | |
| 2005/0198839 | A1 | 9/2005 | Walker | |
| 2006/0162167 | A1 | 7/2006 | Walker | |
| 2006/0277769 | A1 | 12/2006 | Coffin et al. | |
| 2007/0193042 | A1 | 8/2007 | Worrick et al. | |
| 2008/0022530 | A1 | 1/2008 | Royle | |
| 2008/0034591 | A1 | 2/2008 | Fung | |
| 2008/0086899 | A1 * | 4/2008 | Gallagher | 30/526 |
| 2008/0196251 | A1 | 8/2008 | Royle | |
| 2008/0256800 | A1 | 10/2008 | Nicoll | |
| 2009/0066218 | A1 | 3/2009 | Fan | |
| 2009/0313837 | A1 | 12/2009 | Winter et al. | |
| 2010/0043242 | A1 * | 2/2010 | Stevens | 30/527 |
| 2010/0083505 | A1 | 4/2010 | Royle et al. | |
| 2010/0132204 | A1 * | 6/2010 | Brown | 30/527 |
| 2010/0154221 | A1 | 6/2010 | De Benedetto et al. | |
| 2010/0313426 | A1 | 12/2010 | Royle | |
| 2011/0010943 | A1 | 1/2011 | Izumi | |
| 2011/0023305 | A1 | 2/2011 | Whelan et al. | |
| 2011/0035950 | A1 | 2/2011 | Royle | |
| 2011/0067245 | A1 | 3/2011 | Bridges et al. | |
| 2011/0088268 | A1 | 4/2011 | Marut | |
| 2011/0138637 | A1 | 6/2011 | Bucco | |
| 2011/0146080 | A1 | 6/2011 | Pauw | |
| 2011/0167641 | A1 | 7/2011 | Brada et al. | |
| 2011/0167653 | A1 | 7/2011 | Psimadas et al. | |
| 2011/0173821 | A1 | 7/2011 | Hage et al. | |
| 2011/0225826 | A1 | 9/2011 | Leventhal | |
| 2011/0239475 | A1 | 10/2011 | Efthimiadis et al. | |
| 2011/0247217 | A1 | 10/2011 | Johnson et al. | |
| 2011/0252646 | A1 * | 10/2011 | Gordon et al. | 30/47 |
| 2011/0277326 | A1 | 11/2011 | Bodet | |
| 2011/0308089 | A1 | 12/2011 | Bridges | |
| 2012/0047754 | A1 | 3/2012 | Schmitt | |
| 2012/0060382 | A1 | 3/2012 | Beugels et al. | |
| 2012/0073149 | A1 * | 3/2012 | Murgida et al. | 30/526 |
| 2012/0073150 | A1 | 3/2012 | Murgida et al. | |
| 2012/0084984 | A1 | 4/2012 | Davis | |
| 2012/0096718 | A1 | 4/2012 | Howell et al. | |
| 2012/0096722 | A1 | 4/2012 | Howell et al. | |
| 2012/0096723 | A1 | 4/2012 | Howell et al. | |
| 2012/0124840 | A1 | 5/2012 | Iaccarino et al. | |
| 2012/0198698 | A1 | 8/2012 | Szczepanowski et al. | |
| 2012/0233868 | A1 | 9/2012 | Bridges et al. | |
| 2012/0255185 | A1 * | 10/2012 | Patel et al. | 30/527 |
| 2012/0260509 | A1 | 10/2012 | Fang et al. | |
| 2012/0291295 | A1 | 11/2012 | Braun | |
| 2012/0297625 | A1 | 11/2012 | Madden | |
| 2013/0081290 | A1 * | 4/2013 | Murgida et al. | 30/527 |
| 2013/0291391 | A1 * | 11/2013 | Stevens | 30/530 |

FOREIGN PATENT DOCUMENTS

| | | | |
|---|---|---|---|
| FR | 2706142 | A1 | 12/1994 |
| GB | 2 116 470 | A | 9/1983 |
| GB | 2 393 679 | A | 4/2004 |
| GB | 2 458 316 | A | 9/2009 |
| JP | 02-034193 | | 2/1990 |
| JP | 02-052694 | | 2/1990 |
| JP | 04-022388 | | 1/1992 |
| JP | 4269992 | A | 9/1992 |
| JP | 9225159 | A | 9/1997 |
| JP | 200300871 | A | 10/2000 |
| JP | 2001046761 | A | 2/2001 |
| WO | WO 89/10245 | | 11/1989 |
| WO | WO 2006/027018 | A1 | 3/2006 |
| WO | WO 2006/108115 | A1 | 10/2006 |
| WO | WO-2011/094887 | A1 | 8/2011 |
| WO | WO-2012/157624 | A1 | 11/2012 |
| WO | WO-2012/158143 | A1 | 11/2012 |
| WO | WO-2012/161449 | A2 | 11/2012 |

* cited by examiner

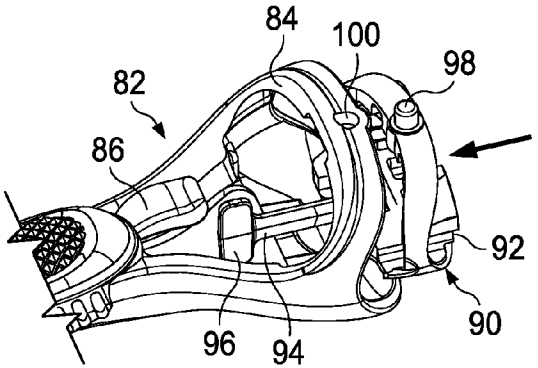
FIG. 10A
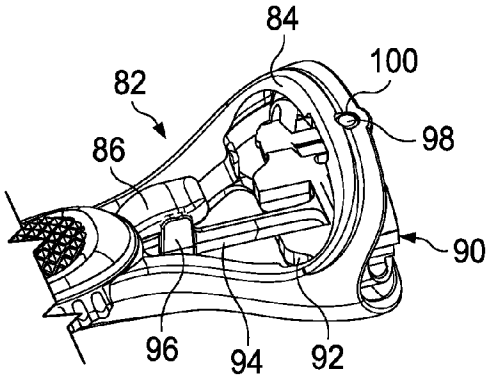
FIG. 10B
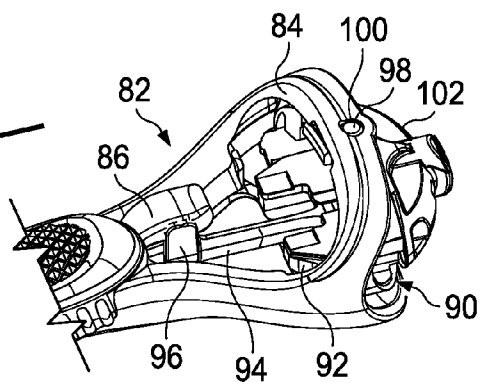
FIG. 10C
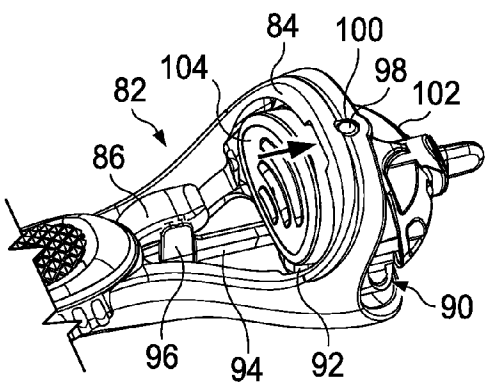
FIG. 10D
FIG. 10E

RAZOR HANDLE WITH A ROTATABLE PORTION

CROSS REFERENCE TO RELATED APPLICATION(S)

This patent application claims priority to U.S. Provisional Application No. 61/387,627, filed Sep. 29, 2010.

FIELD OF THE INVENTION

The invention generally relates to handles for razors, more particularly to handles with a rotatable portion.

BACKGROUND OF THE INVENTION

Recent advances in shaving razors, such as a 5-bladed or 6-bladed razor for wet shaving, may provide for closer, finer, and more comfortable shaving. One factor that may affect the closeness of the shave is the amount of contact for blades on a shaving surface. The larger the surface area that the blades contact then the closer the shave becomes. Current approaches to shaving largely comprise of razors with only a single axis of rotation, for example, about an axis substantially parallel to the blades and substantially perpendicular to the handle (i.e., front-and-back pivoting motion). The curvature of various shaving areas, however, does not simply conform to a single axis of rotation and, thus, a portion of the blades often disengage from the skin during shaving as they have limited ability to pivot about the single axis. Therefore, blades on such razors may only have limited surface contact with certain shaving areas, such as under the chin, around the jaw line, around the mouth, etc.

Razors with multiple axes of rotation may help in addressing closeness of shaving and in more closely following skin contours of a user. For example, a second axis of rotation for a razor can be an axis substantially perpendicular to the blades and substantially perpendicular to the handle, such as side-to-side pivoting motion. Examples of various approaches to shaving razors with multiple axes of rotation are described in U.S. Pat. Nos. 5,029,391; 5,093,991; 5,526,568; 5,560,106; 5,787,593; 5,953,824; 6,115,924; 6,381,857; 6,615,498; and 6,880,253; U.S. Patent Application Publication Nos. 2009/066218; 2009/0313837; 2010/0043242; and 2010/0083505; and Japanese Patent Laid Open Publication Nos. H2-34193; H2-52694; and H4-22388. However, to provide another axis of rotation, such as an axis substantially perpendicular to the blades and substantially perpendicular to the handle; typically, additional parts are implemented with increased complexity and movement. Furthermore, these additional components often require tight tolerances with little room for error. As a result, current approaches introduce complexities, costs, and durability issues for manufacturing, assembling, and using razors with multiple axes of rotation.

What is needed, then, is a razor, suitable for wet or dry shaving, with multiple axes of rotation, for example, an axis substantially perpendicular to the blades and substantially perpendicular to the handle and an axis substantially parallel to the blades and substantially perpendicular to the handle. The razor, including powered and manual razors, is preferably simpler, cost-effective, reliable, durable, easier and/or faster to manufacture, and easier and/or faster to assemble with more precision.

SUMMARY OF THE INVENTION

In one aspect, the invention relates to a handle for a shaving razor. The handle comprises a frame and a pod operably coupled to the frame such that the pod is configured to rotate about an axis substantially perpendicular to the frame. The pod comprises a base and a cantilever tail extending from the base. A distal end of the cantilever tail is not fixed in position and/or is loosely retained by the frame. The cantilever tail generates a return torque upon rotation of the pod about the axis.

The foregoing aspect can include one or more of the following embodiments. The frame can define at least one aperture therethrough and the base can comprise at least one projection extending therefrom. The at least one aperture of the frame can be configured to receive the at least one projection of the base to couple the pod to the frame such that the at least one projection can rotate in the at least one aperture so that the pod can rotate about the axis. Each of the at least one aperture and the at least one projection can be generally cylindrical. The frame can comprise a substantially rigid cradle such that the pod can be coupled to the cradle. The frame can also comprise at least one wall loosely retaining the distal end of the cantilever tail. The distal end of the cantilever tail can move or flex upon rotation of the pod. The at least one wall can comprise a first wall and a second wall that are offset such that the first wall and the second wall can be substantially parallel and non-coplanar. The cradle, the first wall, and the second wall can be integrally formed. The pod can be unitary. Substantially all of the cantilever tail can flex when the pod rotates. The cantilever tail can form a substantially T-shaped configuration comprising an elongate stem and a perpendicular bar at the distal end of the cantilever tail such that the perpendicular bar is loosely retained by the frame. Each of the elongate stem and the perpendicular bar can be generally rectangular. A thickness of the elongate stem can flare larger towards the base. The perpendicular bar can be twisted when the pod is in an at rest position. The perpendicular bar can be twisted about 5 degrees to about 10 degrees when the pod is in the at rest position. The elongate stem may not contact the frame. The elongate stem can generate the return torque upon rotation of the pod. The pod can be configured to rotated about +/−24 degrees from an at rest position. The return torque of the cantilever tail can be in a range of about 8 N*mm to about 16 N*mm when the pod has been rotated about 12 degrees from an at rest position.

In another aspect, the invention relates to a shaving razor. The shaving razor comprises a handle comprising a frame and a blade cartridge connecting assembly operably coupled to the frame such that the blade cartridge connecting assembly is configured to rotate about a first axis substantially perpendicular to the frame. The blade cartridge connecting assembly comprises a pod in the pod comprises a base and a cantilever tail extending from the base. A distal end of the cantilever tail is loosely retained by the frame. The cantilever tail generates a return torque upon rotation of the pod. The shaving razor also comprises a blade cartridge unit releasably attached to the blade cartridge connecting assembly. The blade cartridge unit comprises at least one blade and the blade cartridge unit is configured to rotate about a second axis substantially parallel to the at least one blade. The blade cartridge unit is configured to rotate about the first axis and the second axis when connected to the blade cartridge connecting assembly.

This aspect can include one or more of the following embodiments. The frame can define at least one aperture therethrough and the base can comprise at least one projection extending therefrom. The at least one aperture of the frame can be configured to receive the at least one projection of the base to couple the pod to the frame such that the at least one projection can rotate in the at least one aperture so that the pod can rotate about the axis. The frame can comprise a substantially rigid cradle such that the pod can be coupled to the cradle. The frame can further comprise at least one wall loosely retaining the distal end of the cantilever tail. The cradle and the at least one wall can be integrally formed. A portion of the cantilever tail may not contact the frame. The return torque of the cantilever tail can be in a range of about 8 N*mm to about 16 N*mm when the pod has been rotated about 12 degrees from an at rest position. The blade cartridge connecting assembly can further comprise a docking station releasably attached to the base of the pod such that the blade cartridge unit can be releasably attached to the docking station.

BRIEF DESCRIPTION OF THE DRAWINGS

Other features and advantages of the present invention, as well as the invention itself, can be more fully understood from the following description of the various embodiments, when read together with the accompanying drawings, in which:

FIGS. 10A-10E depict a procedure for assembling a portion of a handle according to an embodiment of the invention;

DETAILED DESCRIPTION OF THE INVENTION

Except as otherwise noted, the articles "a," "an," and "the" mean "one or more."

Figure 1:
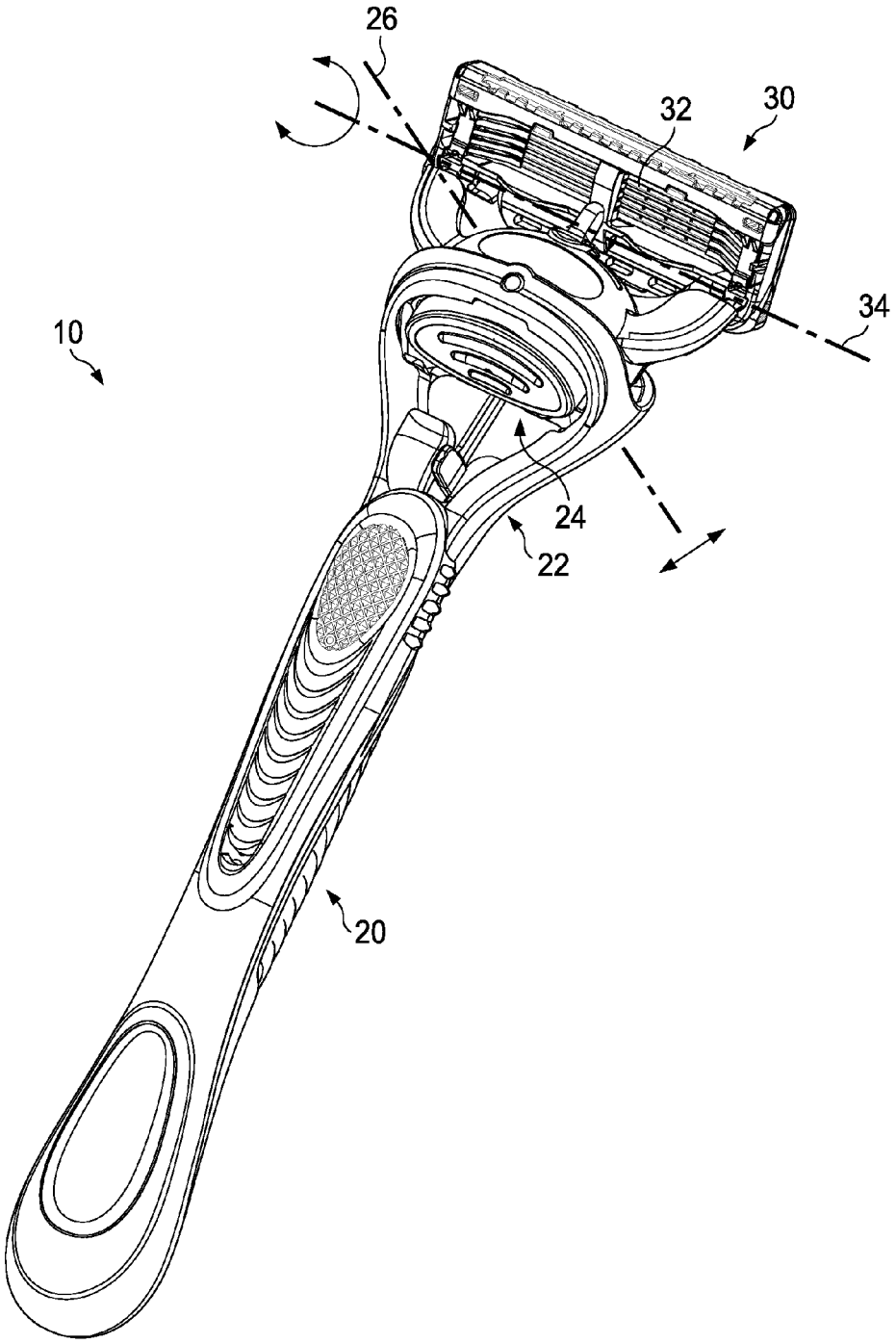
FIG. 1 is a schematic perspective view of a rear of a shaving razor in accordance with an embodiment of the invention.
Figure 2:
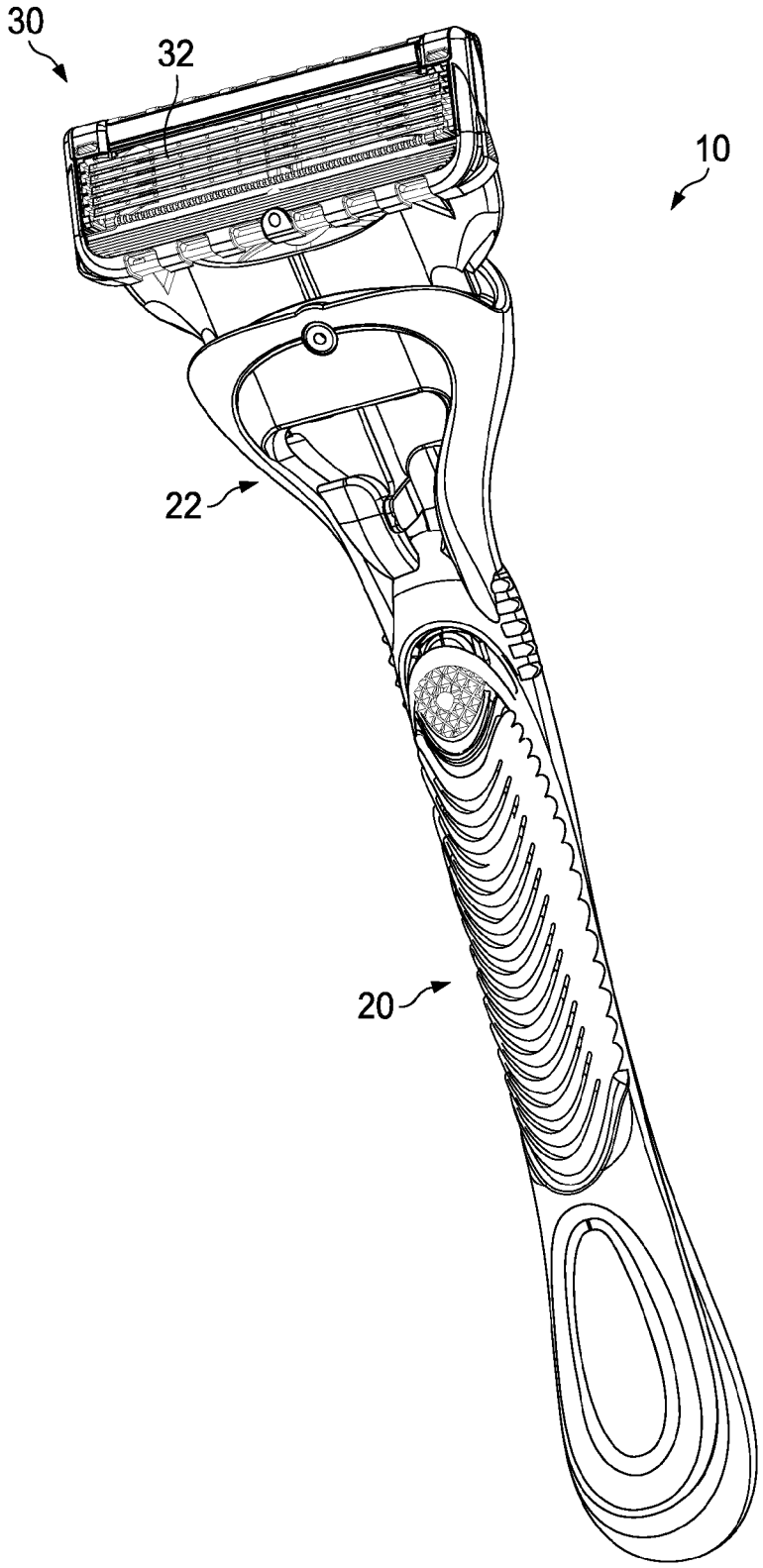
FIG. 2 is a schematic perspective view of a front of the shaving razor of FIG. 1.

Referring to FIGS. 1 and 2, a shaving razor 10 of the present invention comprises a handle 20 and a blade cartridge unit 30, which removably connects or releasably attaches to the handle 20 and contains one or more blades 32. The handle 20 comprises a frame 22 and a blade cartridge connecting assembly 24 operably coupled thereto such that the blade cartridge connecting assembly 24 is configured to rotate about an axis of rotation 26 that is substantially perpendicular to the blades 32 and substantially perpendicular to the frame 22. The blade cartridge unit 30 is configured to rotate about an axis of rotation 34 that is substantially parallel to the blades 32 and substantially perpendicular to the handle 20. Nonlimiting examples of suitable blade cartridge units are described in U.S. Pat. No. 7,168,173. When the blade cartridge unit 30 is attached to the handle 20 via the blade cartridge connecting assembly 24, the blade cartridge unit 30 is configured to rotate about multiple axes of rotation, for example, a first axis of rotation 26 and a second axis of rotation 34.

Figure 3:
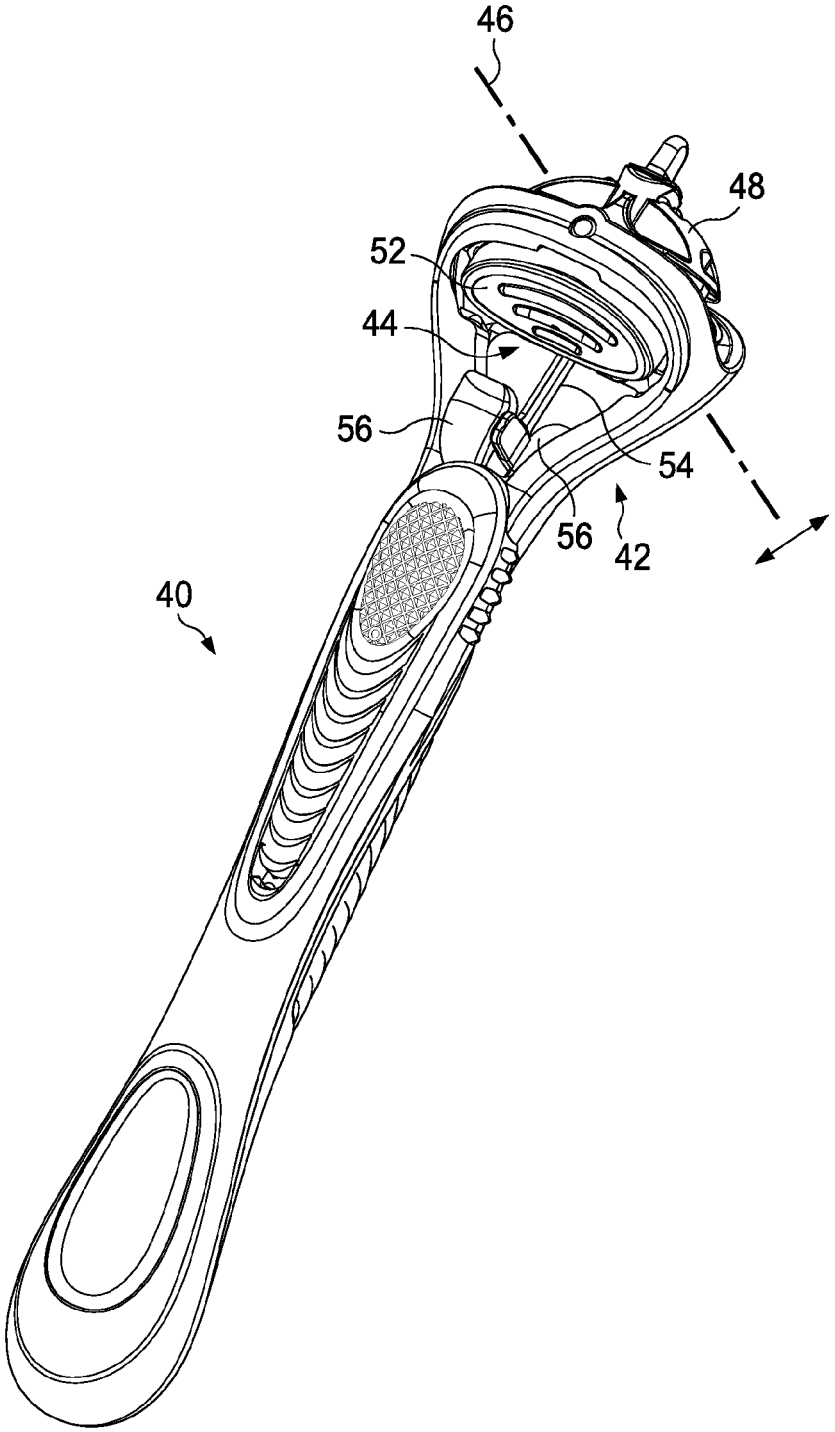
FIG. 3 is a schematic perspective view of a rear of a handle of a shaving razor according to an embodiment of the invention.
Figure 4:
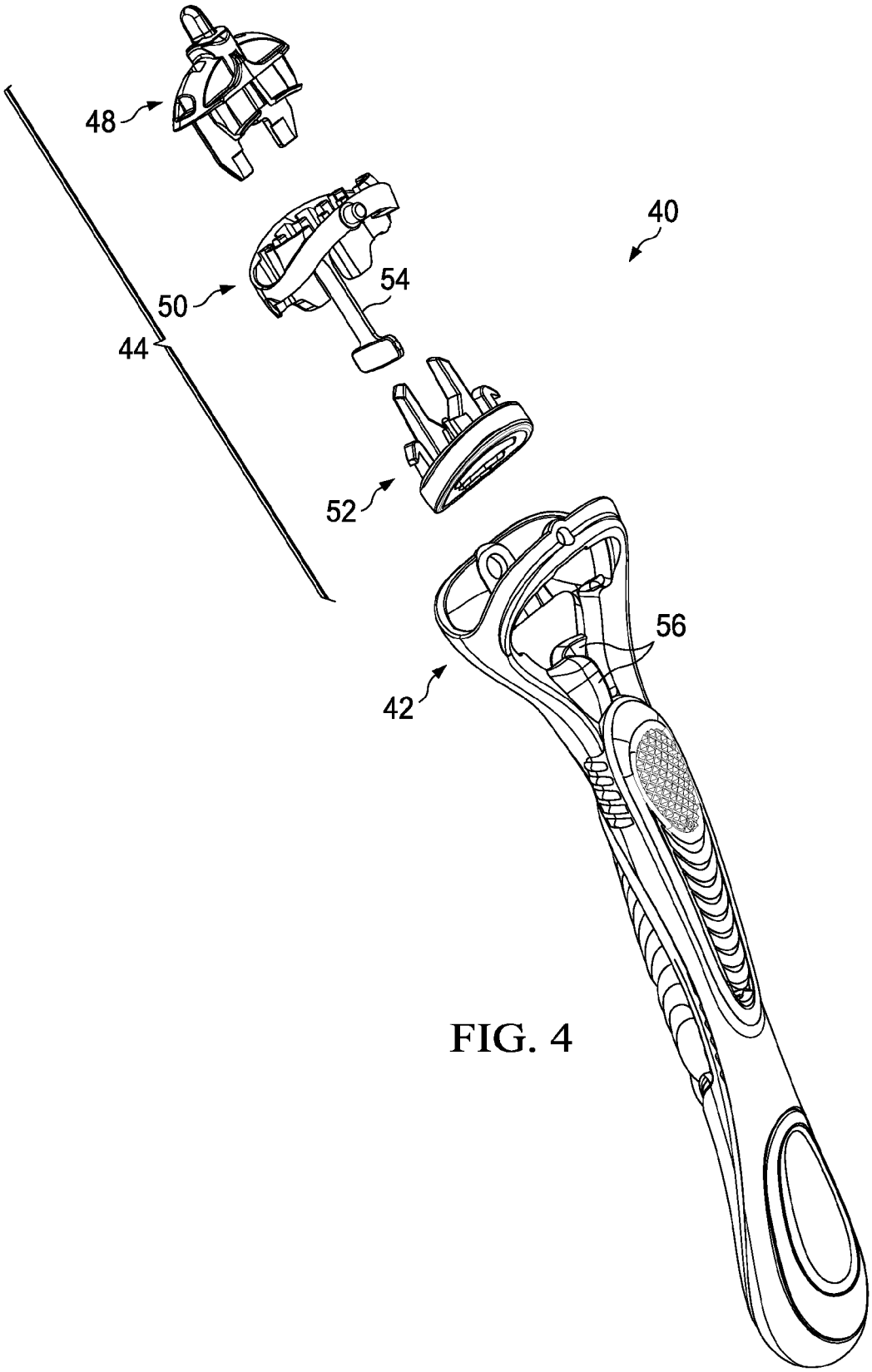
FIG. 4 is a schematic exploded perspective view of the handle of FIG. 3.
Figure 5:
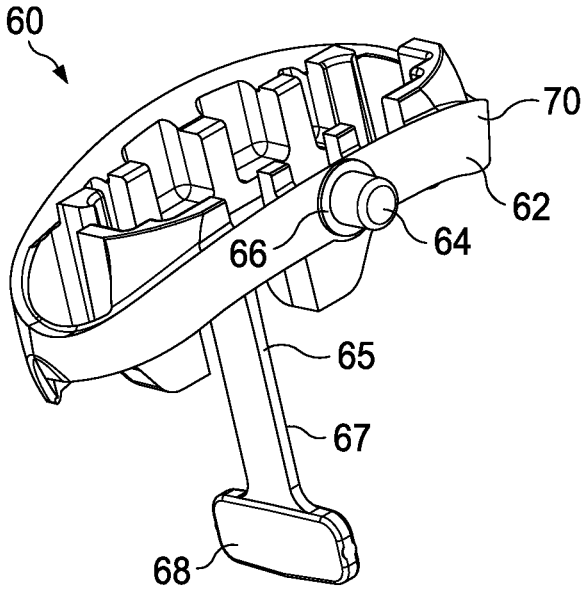
FIG. 5 is a schematic perspective view of a pod in accordance with an embodiment of the invention.
Figure 6:
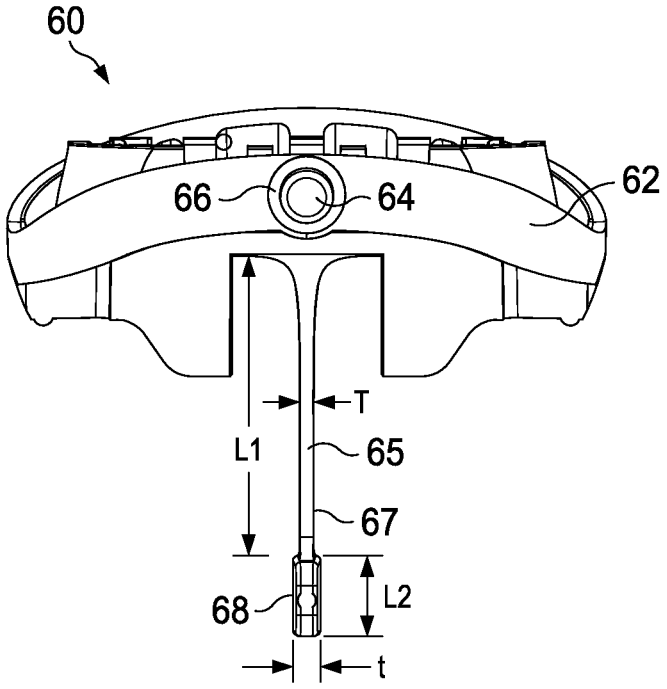
FIG. 6 is a schematic rear view of the pod of FIG. 5.
Figure 7:
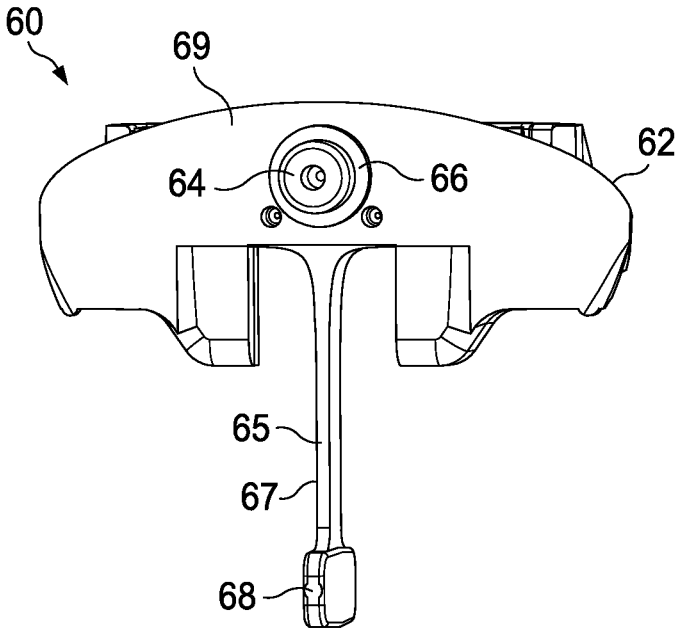
FIG. 7 is a schematic perspective view of a front of the pod of FIG. 5.
Figure 8:
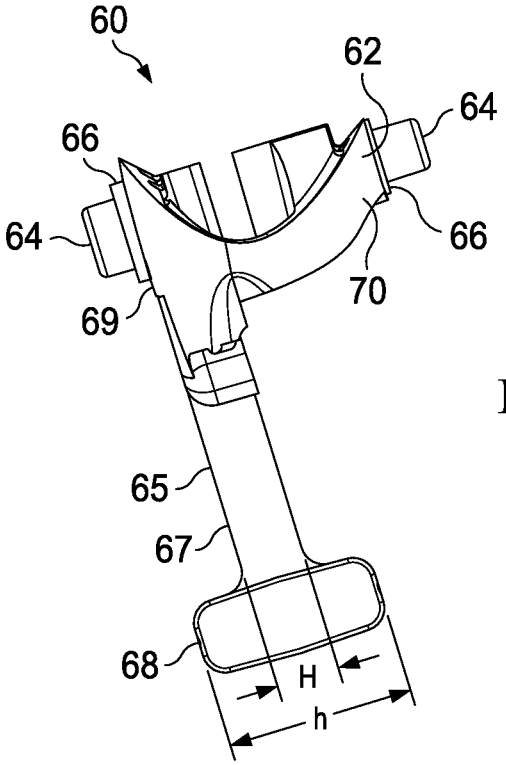
FIG. 8 is a schematic side view of the pod of FIG. 5.

FIGS. 3 and 4 depict an embodiment of a handle 40 of the present invention. The handle 40 comprises a frame 42 and a blade cartridge connecting assembly 44 operably coupled thereto such that the blade cartridge connecting assembly 44 is configured to rotate about an axis of rotation 46 that is substantially perpendicular to the frame 42. The blade cartridge connecting assembly 44 comprises a docking station 48 engageable with a blade cartridge unit (not shown), a pod 50, and an ejector button assembly 52. The pod 50 is operably coupled to the frame 42, such that it is rotatable relative to the frame 42, with the docking station 48 and the ejector button assembly 52 removably or releasably attached to the pod 50. Nonlimiting examples of suitable docking stations and ejector button assemblies are described in U.S. Pat. Nos. 7,168,173 and 7,690,122 and U.S. Patent Application Publication Nos. 2005/0198839, 2006/0162167, and 2007/0193042. In an embodiment, the pod 50 is flexible such that it is separable from the frame 42. The pod 50 comprises a cantilever tail 54 in which a distal end of the cantilever tail 54 is loosely retained by a pair of offset walls 56 of the frame 42. The cantilever tail 54 generates a return torque when the pod 50 is rotated about axis 46 such that the pod 50 is returned to an at rest position. Nonlimiting examples of suitable springs retained between walls to generate a return torque are described in U.S. Pat. No. 3,935,639 and shown by the Sensor® 3 disposable razors (available from the Gillette Co., Boston, Mass.).

FIGS. 5 through 8 depict a pod 60 of the present invention. The pod 60 comprises a base 62 with one or more projections 64 and a cantilever tail 65 extending therefrom. The projections 64 may extend from any exterior portion of the base 62. In an embodiment, the projections 64 are generally cylindrical. By "generally cylindrical" the projections 64 may include non-cylindrical elements, e.g., ridges, protrusions, or recesses, and/or may include regions along its length that are not cylindrical, such as tapered and/or flared ends due to manufacturing and design considerations. Additionally or alternatively, one or more of the projections 64 may include a bearing pad 66 of larger size between the projections 64 and the base 62. For example, each of the projections 64 may include a bearing pad 66 of larger size between the projections 64 and the base 62. In an embodiment, the cantilever tail 65 forms a substantially T-shaped configuration comprising an elongate stem 67 and a perpendicular bar 68 at a distal end. In an embodiment, the elongate stem 67 and the perpendicular bar 68 are each generally rectangular. By "generally rectangular" the elongate stem 67 and the perpendicular bar 68 may each include non-rectangular elements, e.g., ridges, protrusions, or recesses, and/or may include regions along its length that are not rectangular, such as tapered and/or flared ends due to manufacturing and design considerations. For example, a thickness (T) of the elongate stem 67 may gradually flare larger towards a proximal end of the elongate stem 67 relative to the base 62. Gradually flaring the thickness of the elongate stem 67 may help to reduce stress concentrations when the pod 60 is rotated so that yield stresses of the material of the elongate stem 67 will not be exceeded, which if exceeded would result in failure such as permanent deformation or fatigue with repeated use. Similarly, a height (H) of the elongate stem 67 may flare larger, e.g., gradually flare larger or quickly flare larger, towards a distal end of the elongate stem 67, as the elongate stem 67 approaches the perpendicular bar 68. In this arrangement, a length (L1) of the elongate stem 67 can be maximized to achieve desirable stiffnesses and return torques when the pod 60 is rotated. Alternatively, the elongate stem 67 and the perpendicular bar 68 may each form any geometric, polygonal, or arcuate shape, e.g., an ovoid shape. An interior of the pod 60 defines a hollow portion therethrough with two open ends, for example, a top end and a bottom end. Interior surfaces of the pod 60 may optionally include projections extending into the hollow portion, grooves, channels, and/or detents to engage corresponding mating shapes of a docking station at one end of the pod 60 and an ejector button assembly at another end of the pod 60. The cantilever tail 65 extends from a front portion 69 of the base 62, though the cantilever tail 66 may alternatively extend from a rear portion 70 of the base 62.

In the present invention, a single component, specifically the pod 60, serves multiple functions. The pod 60 facilitates an axis of rotation in a razor handle, namely an axis of rotation substantially perpendicular to one or more blades when a razor is assembled and substantially perpendicular to a frame of a handle. When rotated from an at rest position, the pod 60 generates a return torque to return to the rest position by way of a spring member, such as a cantilever spring or a leaf spring. The return torque is generated by the cantilever tail 65 of the pod 60. For example, the return torque is generated by elongate stem 67 of the cantilever tail 65. The pod 60 also serves as a carrier for an ejector button assembly, a docking station, and/or a blade cartridge unit (e.g., via the docking station).

In an embodiment, the pod 60 is unitary and, optionally, formed from a single material. Additionally or alternatively, the material is flexible such that the entire pod 60 is flexible. Preferably, the pod 60 is integrally molded such that the cantilever tail 65, which comprises the elongate stem 67 and the perpendicular bar 68, and the base 62 are integrally formed. A unitary design ensures that the base 62 and the cantilever tail 65 are in proper alignment to each other. For example, the position of the cantilever tail 65 relative to an axis of rotation is then controlled, as well as the perpendicular orientation of the base 62 and the cantilever tail 65. Furthermore, the base 62 and the cantilever tail 65 do not separate upon drop impact.

Figure 9:
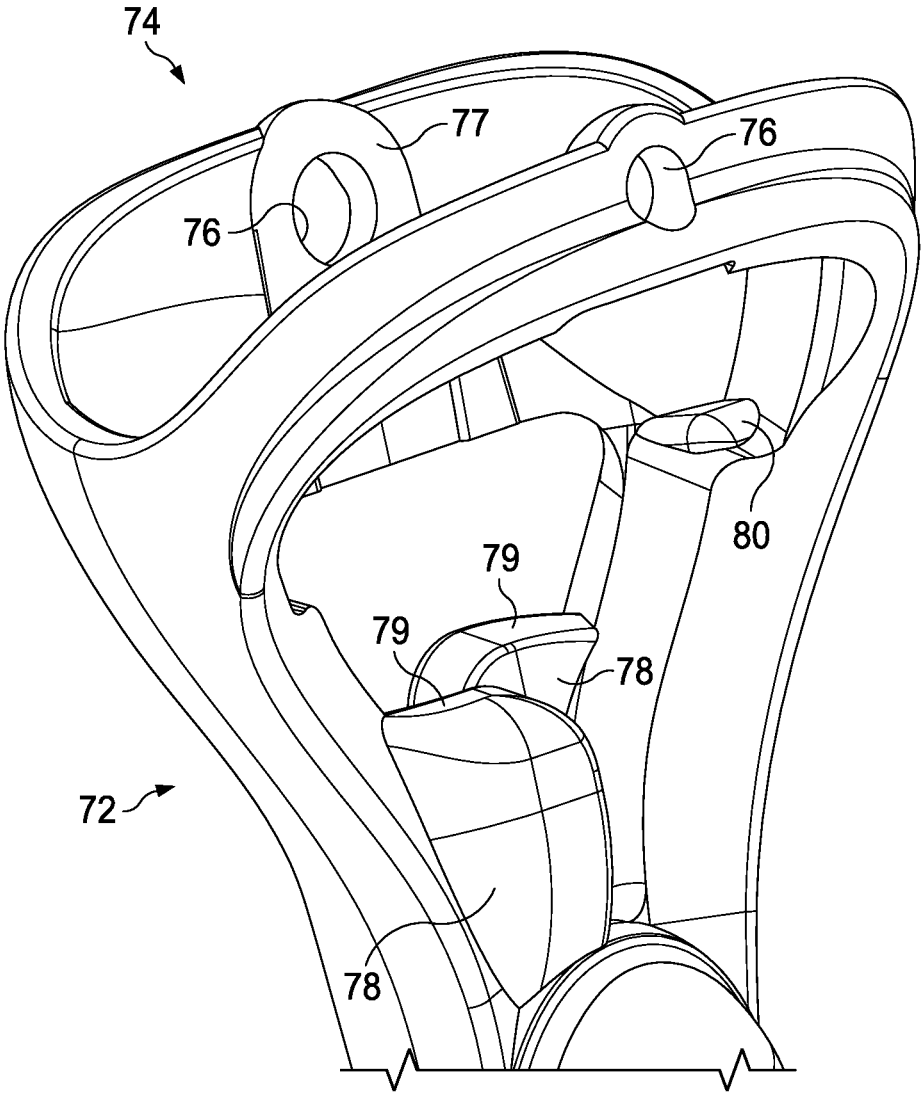
FIG. 9 is a schematic perspective view of a portion of a frame of a handle according to an embodiment of the invention.

Referring now to FIG. 9, a portion of a frame 72 of a handle comprises a cradle 74 and one or more apertures 76 defined in the cradle 74. In an embodiment, the apertures 76 are generally cylindrical. By "generally cylindrical" the apertures 76 may include non-cylindrical elements, e.g., ridges, protrusions, or recesses, and/or may include regions along its length that are not cylindrical, such as tapered and/or flared ends due to manufacturing and design considerations. Furthermore, the cradle can be open at least at one end and define a hollow interior portion. Additionally or alternatively, a bearing surface 77 may surround one or more of the apertures 76 such that the bearing surface 77 extends into the hollow interior portion. For example, bearing surfaces 77 may surround each of the apertures 76. One or more walls 78 may have a portion thereof that extends into the hollow interior portion. In an embodiment, a pair of walls 78 may each have a portion that extends into the hollow interior portion. Optionally, the pair of walls 78 may be offset such that they are not in opposing alignment. For example, the walls 78 can be generally parallel and generally non-coplanar. Furthermore, the pair of walls 78 may be arranged so that they do not overlap. Top surfaces 79 of the walls 78 may have a lead-in surface, such as a sloped top surface or a rounded edge top surface to lead a distal end of a cantilever tail of a pod into and between the walls 78 during assembly. Additionally or alternatively, the hollow interior portion may also include at least one shelf 80 or at least one sloped surface that at least partially extends into the hollow interior portion.

In one embodiment, the cradle 74 forms a closed, integral loop to provide structural strength and integrity. Alternatively, the cradle does not form a closed loop, but is still integrally formed. Where the cradle does not form a closed loop, the cradle can be made thicker for added strength and integrity. In forming an integral structure, the cradle 74 does not require separate components for assembly; separate components may come apart upon drop impact. An integral structure facilitates easier manufacturing, e.g., via use of a single material, and when the cradle 74 is, optionally, substantially rigid or immobile, the rigidity helps to prevent the apertures 76 from spreading apart upon drop impact and thus helps to prevent release of an engaged pod. Thus, the cradle 74 can be durable and made from non-deforming material, e.g., metal diecast, such as zinc diecast, or substantially rigid or immobile plastic. The rigidity of the cradle 74 also facilitates more reliable control of the distance of the apertures 76 as well as their concentric alignment. In an embodiment, the cradle 74 is integrally formed with the walls 78 to form one component. Additionally or alternatively, the entire frame 72 of the handle can be substantially rigid or immobile in which soft or elastic components may be optionally disposed on the frame 72 to assist with a user gripping the razor.

FIGS. 10A through 10E depict a procedure for assembling a handle of the present invention. A frame 82 of the handle comprises a cradle 84 defining an opening at least at one end and a hollow interior portion therein. Each of a pair of offset walls 86 of the frame 82 has a portion thereof that extends into the hollow interior portion. A flexible pod 90 comprises a base 92 and a flexible cantilever tail extending from the base 92. The cantilever tail comprises an elongate stem 94 and a perpendicular bar 96 at a distal end thereof. To engage the frame 82 and the pod 90, the pod 90 is positioned (Step 1) within the hollow interior portion of the frame 82 and aligned such that a first mounting member 98 of the pod 90 correspond in shape and align with a second mounting member 100 of the frame 82 and the perpendicular bar 96 of the cantilever tail is located near the walls 86 of the frame 82. In an embodiment, the first mounting member 98 of the pod 90 comprise one or more projections extending from the base 92 and the second mounting member 100 of the frame 82 comprise one or more apertures formed in the cradle 84. To assist in preventing improper alignment and engagement of the pod 90 and the cradle 84, in embodiments with a plurality of projections extending from the base 92 and a plurality of apertures formed in the cradle 84, one of the projections is larger than the other projections and one of the corresponding apertures is larger than the other apertures. Additionally or alternatively, the first mounting member 98 of the pod 90 comprise one or more apertures formed in the base 92 and the second mounting member 100 of the frame 82 comprises one or more projections extending into the hollow interior portion of the cradle 84. The base 92 and/or the first mounting member 98 of the pod 90 are then compressed and positioned (Step 2) such that the first mounting member 98 aligns with the second mounting member 100 and the perpendicular bar 96 is located between the walls 86. When decompressed, the first mounting member 98 mates with the second mounting member 100 and the perpendicular bar 96 is loosely retained by the walls 86. In an embodiment, of the cantilever tail, only the distal end of the cantilever tail, specifically the perpendicular bar 96, contacts the frame 82 when the pod 90 is decompressed. For example, substantially all of the elongate stem 94 of the cantilever tail does not contact the frame 82. In an embodiment in which the pod 90 comprises bearing pads and the cradle 84 comprises bearing surfaces, when the pod 90 is coupled to the cradle 84, the bearing pads of the pod 90 are configured such that substantially the remaining portions of the base 92 (e.g., other than the bearing pads and the first mounting member 98) do not contact the cradle 84. Having only the bearing pads and the first mounting member 98 contact the cradle 84 serves to reduce or minimize the friction and/or resistance of the pod 90 when rotated relative to the cradle 84. A portion of a docking station 102 is then positioned (Step 3) within a hollow interior portion of the pod 90 and then mated (Step 4) to the pod 90 such that extensions of the docking station 102 correspond in shape and mate with grooves and/or detents on an interior surface of the pod 90. In an embodiment, the docking station 102 is substantially rigid such that the pod 90 is locked into engagement with the frame 82 when the docking station 102 is coupled to the pod 90. Additionally or alternatively, the docking station 102 is stationary relative to the pod 90. For example, wires can stake the docking station 102 to the pod 90. In an embodiment, when the docking station 102 is staked to the pod 90, the docking station 102 can expand the pod 90, for example, the distance between the projections, beyond the pod's 90 as-molded dimensions. An ejector button assembly 104 corresponds in shape and mates (Step 5) with the pod 90 by aligning and engaging extensions of the ejector button assembly 104 with corresponding grooves and/or detents on the interior surface of the pod 90. In an embodiment, once the ejector button assembly 104 is engaged to the pod 90, the ejector button assembly 104 is movable relative to the pod 90 and the docking station 102 such that movement of the ejector button assembly 104 ejects an blade cartridge unit attached to the docking station. In an alternative embodiment, the ejector button assembly 104 can be engaged to the pod 90 before the docking station 102 is engaged to the pod 90.

Figure 11:
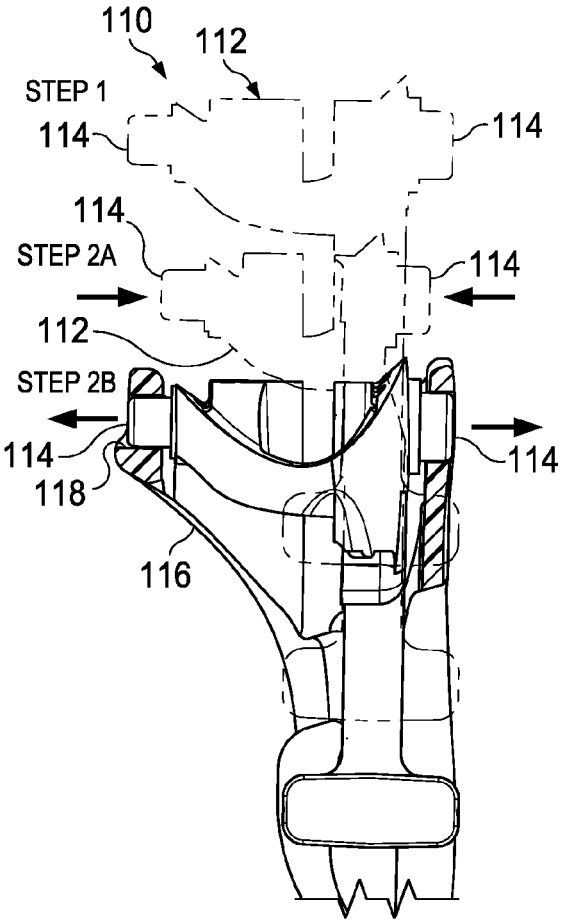
FIG. 11 depicts a procedure for compressing a pod in accordance with an embodiment of the invention.

FIG. 11 depicts a procedure for compressing and decompressing a flexible pod 110, which comprises a base 112 and one or more projections 114 extending from the base 112. In an embodiment, the entire pod 110 is flexible and, therefore, compressible such that the pod 110 is engageable with a frame 116 (shown in sectional view in FIG. 11) defining one or more apertures 118 and a hollow interior portion. To engage the pod 110 to the frame 116, similar as to discussed above, the pod 110 is positioned (Step 1) within the hollow interior portion of the frame 116. The base 112 and/or the projections 114 of the pod 110 are then compressed (Step 2A) such that the projections 114 freely clear the hollow interior portion of the frame 116 and the projections 114 can then align with the apertures 118. By compressing the base 112 along the portions with the projections 114, the base 112 and the projections 114 of the pod 110 fit substantially entirely within the hollow interior of the frame 116. When decompressed (Step 2B), the pod 110 is free to spring back to is open, natural position and the projections 114 mate with the apertures 118. In an embodiment, when decompressed, the projections 114 penetrate deep into the apertures 118 for a secure fit into the frame 116, which can be substantially rigid or immobile. Additionally or alternatively, the projections 114 correspond in size and mate with the apertures 118 via a pin arrangement, ball and socket arrangement, snap-fit connection, and friction-fit connection.

A distal end of the projections 114 can be disposed about or near an exterior surface of the frame 116. In such an arrangement, robustness of the entire razor assembly need not be compromised so that features can jump each other in assembly. Additionally, separate features or components are unnecessary to achieve deep penetration into the apertures 118. For example, the apertures 118 are not defined by more than one component and the apertures 118 do not need to be partially open on the top or bottom to engage the projections 114 into the apertures 118. Because the frame 116 is formed from substantially rigid or immobile material, the projections 114 and the apertures 118 can be designed to engage without requiring any secondary activity, such as dimensional tuning, to ensure proper positioning while also minimizing the slop of the pod 110 when rotating relative to the frame 116. In an embodiment, the frame 116 is integrally formed with the walls, such as a pair of offset walls, to form one substantially rigid or immobile component. In such an arrangement, the rest position of the pod 110 is more precisely controlled.

Figure 12A:
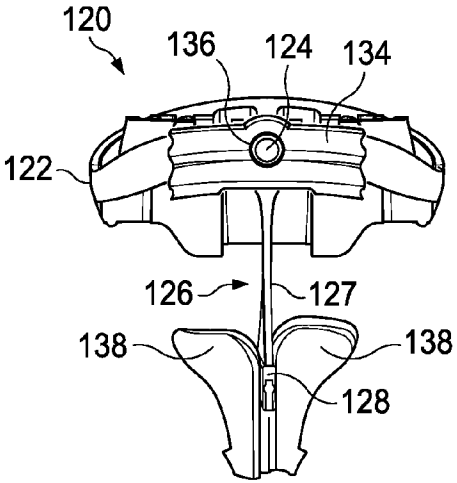
FIGS. 12A-12C depict a schematic front view of a pod and a portion of a frame of a handle during various stages of rotation according to an embodiment of the invention.
Figure 12B:
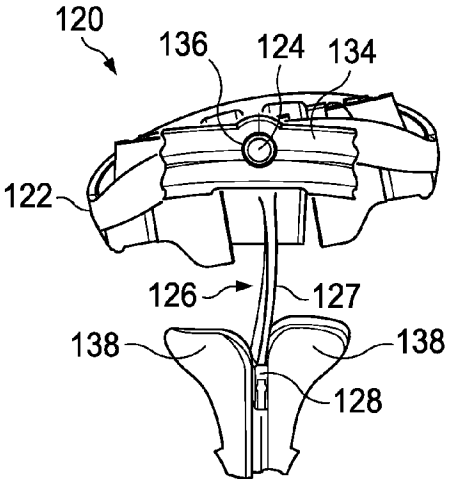
Figure 12C:
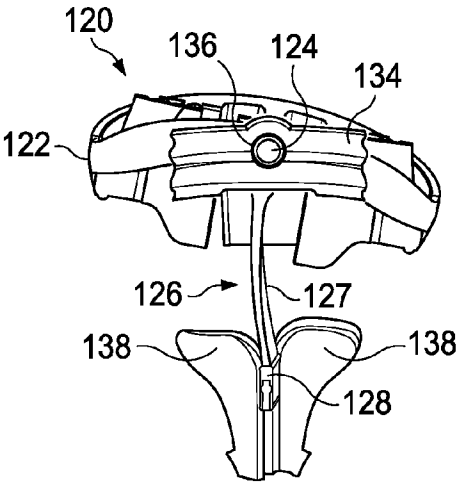

FIGS. 12A though 12C depict a portion of a handle during various stages of rotation. A flexible pod 120 comprises a base 122 with projections 124 and a cantilever tail 126 extending therefrom. The cantilever tail 126 comprises an elongate stem 127 and a perpendicular bar 128 at a distal end thereof. A frame 134 defines one or more apertures 136, and the frame 134 also comprises a pair of offset walls 138. FIG. 12A depicts a rest position of the pod 120 with respect to the frame 134 when no forces are being applied to the pod 120. In an embodiment, the cantilever tail 126 can have a spring preload when engaged with the frame 134 which minimizes or eliminates wobbliness of the pod 120 when the pod 120 is in the rest position. The spring preload provides stability to a blade cartridge unit upon contact with a shaving surface. In such an arrangement, the rest position of the pod 120 is a preloaded neutral position. Aligning the pod 120 in the preloaded neutral position relative to the frame 134 and establishing the spring preload are precisely controlled due to the pod 120 being a single, unitary component and the frame 134 and the walls 138 being formed from a single, unitary component. Further, by loosely retaining the perpendicular bar 128 of the cantilever tail 126 with a pair of offset walls 138, the requirement for clearance, for example, to account for manufacturing errors and tolerances, between the perpendicular bar 128 and the walls 138 is minimized or eliminated. The offset of the walls 138 allows the perpendicular bar 128 to spatially overlap the walls 138 without having the walls 138 grip or restrain the perpendicular bar 128, thereby avoiding the necessity of opposing retaining walls. Opposing retaining walls require clearance between the walls and the perpendicular bar to allow for free movement of the perpendicular bar and for manufacturing clearances. Such a clearance would result in unrestrained or sloppy movement of the pod 120 at the preloaded neutral position as well as perhaps a zero preload. Alternatively, opposing retaining walls without clearance would pinch the perpendicular bar and restrict motion.

When forces are applied to the pod 120, for example, via the blade cartridge unit when coupled to the pod 120, the pod 120 can rotate relative to the frame 134. The projections 124 of the pod 120 are sized such that the projections 124 rotate within the apertures 136 to facilitate rotation of the pod 120. In such an arrangement, when the pod 120 is engaged to the frame 134, the projections 124 can only rotate about an axis, but not translate. In an embodiment, the projections 124 have a fixed axis (i.e., the concentric alignment of the apertures 136) that it can rotate about. Additionally or alternatively, the projections 124 can be sized so that frictional interference within the apertures 136 provides certain desirable movement or properties. When the pod 120 is rotated, because the perpendicular bar 128 of the pod 120 is loosely retained by the pair of offset walls 138, the offset walls 138 interfere with and twist the perpendicular bar 128 of the pod 120 such that the elongate stem 127 flexes. Optionally, substantially all of the cantilever tail 126, including the elongate stem 127 and the perpendicular bar 128 flexes or moves during rotation. Alternatively, upon rotation, only a portion of the cantilever tail 126, specifically the elongate stem 127, flexes or moves. In flexing, the cantilever tail 126 generates a return torque to return the pod 120 to the rest position. In an embodiment, the elongate stem 127 generates the return torque upon rotation of the pod 120. The larger the rotation of the pod 120, the larger the return torque is generated. The range of rotation from the preloaded neutral position can be about +/−4 degrees to about +/−24 degrees, preferably about +/−8 degrees to about +/−16 degrees, and even more preferably about +/−12 degrees. The frame 134 of the handle can be configured to limit the range of rotation of the pod 120. In an embodiment, shelves or sloping surfaces that extend into the interior of the frame 134 can limit the range of rotation of the pod 120 in that an end of the pod 120 will contact the respective shelf or sloping surface. The return torque can be either linear or non-linear acting to return the pod 120 to the rest position. In an embodiment, when rotated to +/−12 degrees from the rest position, the return torque can be about 12 N*mm.

Various return torques can be achieved through combinations of material choice for a pod and dimensions of a cantilever tail. In various embodiments, to achieve a desired return torque, the material and/or shape of the pod can be selected from a range of a highly flexible material with a thick and/or short cantilever tail to a substantially rigid material with a thin and/or long cantilever tail. A range of desired return torque can be about 0 N*mm to about 24 N*mm, preferably about 8 N*mm to about 16 N*mm, and even more preferably about 12 N*mm. Preferably, the pod is formed from thermoplastic polymers. For example, nonlimiting examples of materials for the pod with desirable properties, such as flexibility, durability (breakdown from drop impact), fatigue resistance (breakdown from bending over repeated use), and creep resistance (relaxing of the material), can include Polylac® 757 (available from Chi Mei Corporation, Tainan, Taiwan), Hytrel® 5526 and 8283 (available from E. I. duPont de Nemours & Co., Wilmington, Del.), Zytel® 122L (available from E. I. duPont de Nemours & Co., Wilmington, Del.), Celcon® M90 (available from Ticona LLC, Florence, Ky.), Pebax® 7233 (available from Arkema Inc., Philadelphia, Pa.), Crastin® S500, S600F20, S600F40, and S600LF (available from E. I. duPont de Nemours & Co., Wilmington, Del.), Celenex® 1400A (M90 (available from Ticona LLC, Florence, Ky.), Delrin® 100ST and 500T (available from E. I. duPont de Nemours & Co., Wilmington, Del.), Hostaform® XT 20 (available from Ticona LLC, Florence, Ky.), and Surlyn® 8150 (available from E. I. duPont de Nemours & Co., Wilmington, Del.). Furthermore, the selection of a material may affect the stiffness and yield stress of the pod or an elongate stem of the cantilever tail. For example, each material may have different stiffnesses depending on the temperature and rate of rotation of the pod relative to the frame. Dimensions of the cantilever tail can be varied to achieve a desired torque and/or a desired stiffness. For example, the cantilever tail can be thicker and/or shorter (for increased stiffness), as well as thinner and/or longer (for decreased stiffness). In an embodiment, the thickness of the cantilever tail, about its widest point, can be about 0.1 mm to about 3.5 mm, preferably about 0.4 to about 1 8 mm, even more preferably about 1.5 mm. The length of the cantilever tail can be about 3 mm to about 25 mm, preferably about 11 mm to about 19 mm, and even more preferably about 16 mm, such as about 16.6 mm. The height of the cantilever tail can be about 0.5 mm to about 14 mm, preferably about 2 mm to about 8 mm, and even more preferably about 6 mm, such as about 6.2 mm.

For example, referring back to FIGS. 5 through 9, a pod 60 of the present invention can be molded from one material, such as Delrin® 500T. To achieve a return torque of the cantilever tail 65 of 12 N*mm when the pod 60 has been rotated +/−12 degrees from an at rest position (e.g., a preloaded neutral position), a length L1 of the elongate stem 67 is about 13.4 mm. A thickness T of the elongate stem 67, measured around its thickest point at about a mid-point along the length L1 of the elongate stem 67, is about 0.62 mm. A height H of the elongate stem 67 is about 2.8 mm. The perpendicular bar 68 of the cantilever tail 65 has a thickness t, measured around its widest point, of about 1.2 mm. In this embodiment, the thickness t of the perpendicular bar 68 is generally thicker than the thickness T of the elongate stem 67, The thickness t of the perpendicular bar 68 affects the preload of the cantilever tail 65, but the thickness t of the perpendicular bar 68 may not generally affect the bending of the elongate stem 67 and, thus, may not affect the return torque when the pod 60 is rotated from the rest position. In an embodiment, a height h of the perpendicular bar 68 is greater than the height H of the elongate stem 67. For example, the height H of the perpendicular bar 68 can be in the range of about 0.2 times to about 5 times the height h of the elongate stem 67, preferably about 2.2 times the height H of the elongate stem 67 (e.g., about 6.2 mm). A length L2 of the perpendicular bar 68 is about 3.2 mm.

When the pod 60 is coupled to the frame 72 of a handle and the perpendicular bar 68 is loosely retained by the pair of offset walls 78, a distance between the center of the height h of the perpendicular bar 68 to the point of contact with an offset wall 78 can be in a range of about 0.4 mm to about 5 mm, preferably about 2.1 mm such that generally a distance between the offset walls 78 is about 4.2 mm. In an embodiment, the dimensions between the walls 78 can vary with the dimensions of the cantilever tail 65. When the pod 60 is coupled to the frame 72 of the handle, the twist of the perpendicular bar 68 is about 9.4 degrees such that one of the offset walls 78 laterally displaces the point of contact of the perpendicular bar 68 in a range of about 0.1 mm to about 1.0 mm, preferably about 0.33 mm. The aperture 76 on the front of the frame 72 is preferably about 3.35 mm in diameter and an aperture 76 on the rear of the frame 72 is preferably about 2.41 mm in diameter. In an embodiment, any of the apertures 76 of the frame 72 can have a diameter sized in the range of about 0.5 mm to about 10 mm. The corresponding projections 64 of the base 62 of the pod 60 are preferably about 3.32 mm and about 2.38 mm in diameter, respectively. In an embodiment, any of the projections 64 of the base 62 can have a diameter sized in the range of about 0.5 mm to about 11 mm. Due to molding of the pod 60, proximal portions of the projections 64 of the pod 60 can be tapered. Additionally or alternatively, the corresponding apertures 76 of the frame 72 can be tapered or not tapered. A distance between bearing surfaces 77 within an interior of the frame 72 is preferably about 12.45 mm. In an embodiment, a distance between bearing surfaces 77 can be in the range of about 5 mm to about 20 mm. When the pod 60 is coupled to the frame 72 and a docking station (not shown) is coupled to the pod 60, a distance between the bearing pads 66 of the pod 60 can be in the range of about 5 mm to about 20 mm, preferably about 12.3 mm.

In an embodiment, to achieve similar stiffness and/or return torques of the elongate stem 67 using other materials, the thickness of the elongate stem 67 can be varied. For example, forming the pod 60 from Hostaform® XT 20, the thickness T1 of the elongate stem 67 can be increased about 13% to about 23%, preferably about 15% to about 21%, and even more preferably about 18%. Forming the pod 60 from Delrin® 100ST, the thickness T1 of the elongate stem 67 can be increased about 14% to about 24%, preferably about 16% to about 22%, and even more preferably about 19%.

Figure 13:
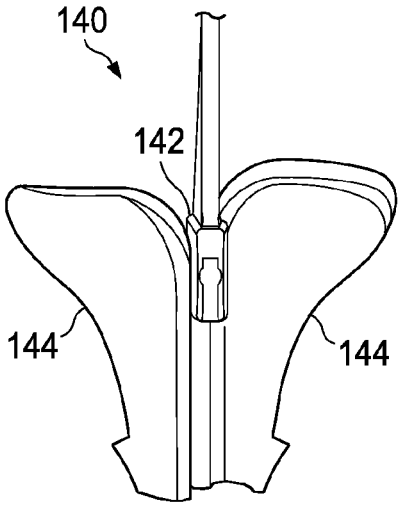
FIG. 13 is a schematic perspective view of a portion of a cantilever tail of a pod and a portion of a frame of a handle in accordance with an embodiment of the invention.

FIG. 13 depicts a portion of a cantilever tail 140 when a pod is in a rest position (e.g., a preloaded neutral position). In an embodiment, a thickness of a perpendicular bar 142 and/or the spacing of a pair of offset walls 144 can be configured such that the perpendicular bar 142 or the entire cantilever tail 140 is twisted, thus forming a spring preload for the cantilever tail 140, when the pod is in the rest position. For example, the angle of twist of the perpendicular bar 142 when the pod is in the preloaded neutral position can be in the range of about 2 degrees to about 25 degrees, preferably about 8 degrees to about 10 degrees, and even more preferably about 9.4 degrees. Additionally or alternatively, the offset walls 144 loosely retain the perpendicular bar 142 without gripping or restraining motion of the perpendicular bar 142 when the perpendicular bar 142 is twisted in the rest position.

The frame, pod, ejector button assembly, docking station, and/or blade cartridge unit are configured for simplification of assembly, for example, in high-speed manufacturing. Each component is configured to automatically align and to securely seat. In an embodiment, each component engages to another component in only a single orientation such that the components cannot be inaccurately or imprecisely assembled. Further, each component does not need an additional step of dimensional tuning or any secondary adjustment in manufacturing to ensure proper engagement with other components. The design of the handle also provides control and precision. For example, when the razor is assembled, the pod and/or the blade cartridge unit is substantially centered, the preload of the cantilever tail and/or the perpendicular bar of the pod is controlled precisely over time even after repeated use, and the performance of the cantilever tail, for example, acting as a spring, is controlled, consistent, and robust.

It should be understood that every maximum numerical limitation given throughout this specification includes every lower numerical limitation, as if such lower numerical limitations were expressly written herein. Every minimum numerical limitation given throughout this specification includes every higher numerical limitation, as if such higher numerical limitations were expressly written herein. Every numerical range given throughout this specification includes every narrower numerical range that falls within such broader numerical range, as if such narrower numerical ranges were all expressly written herein.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shaving razor comprising:

a handle comprising:

a frame; and a blade cartridge connecting assembly operably coupled to the frame such that the blade cartridge connecting assembly is configured to rotate about a first axis substantially perpendicular to the frame, the blade cartridge connecting assembly comprising a pod, said pod comprising:

a base; and a cantilever tail extending from the base, a distal end of the cantilever tail retained by the frame allowing the distal end to move, wherein the cantilever tail generates a return torque upon rotation of the pod relative to the frame; and a blade cartridge unit releasably attached to the blade cartridge connecting assembly, the blade cartridge unit comprising at least one blade and the blade cartridge unit is configured to rotate about a second axis substantially parallel to the at least one blade, wherein the blade cartridge unit is rotatably connected to the blade cartridge connecting assembly such that the blade cartridge unit is configured to rotate about the first axis and the second axis.

2. The shaving razor of claim 1, wherein the frame defines at least one aperture therethrough and wherein the base comprises at least one projection extending therefrom, the at least one aperture of the frame configured to receive the at least one projection of the base to operably couple the pod to the frame such that the at least one projection can rotate in the at least one aperture so that the pod can rotate about the first axis.

3. The shaving razor of claim 1, wherein the frame comprises a substantially rigid cradle and the pod is operably coupled to the cradle.

4. The shaving razor of claim 3, wherein the frame further comprises a pair of walls retaining the distal end of the cantilever tail.

5. The shaving razor of claim 4, wherein the cradle and the pair of walls are integrally formed.

6. The shaving razor of claim 1, wherein the return torque of the cantilever tail is in a range of about 8 N*mm to about 16 N*mm when the pod has been rotated about 12 degrees from an at rest position.

7. The shaving razor of claim 1, wherein the blade cartridge connecting assembly further comprises a docking station releasably attached to the base of the pod such that the blade cartridge unit is releasably attached to the docking station.

* * * * *